US005561878A

United States Patent [19]

Ruehl

[11] Patent Number: 5,561,878

[45] Date of Patent: Oct. 8, 1996

[54] HOSPITAL BED WITH INTEGRAL SELECTIVELY MANIPULATABLE SUPPORT

[75] Inventor: John W. Ruehl, Shelbyville, Ind.

[73] Assignee: Hill-Rom Company, Inc., Batesville, Ind.

[21] Appl. No.: 316,512

[22] Filed: Sep. 30, 1994

[51] Int. Cl.[6] ..... A61G 7/00; A61G 7/05

[52] U.S. Cl. ..... 5/621; 5/622; 5/624

[58] Field of Search ..... 5/621, 622, 624, 5/600, 612, 615

[56] References Cited

U.S. PATENT DOCUMENTS

| | | | |
|---|---|---|---|
| Re. 26,411 | 6/1968 | Alsobrook, Jr. . | |
| 477,449 | 6/1892 | Pirrung . | |
| 509,729 | 11/1893 | Goodnow . | |
| 743,344 | 11/1903 | Souder et al. . | |
| 1,336,943 | 4/1920 | Crane, Jr. . | |
| 1,418,501 | 6/1922 | Weinshenk . | |
| 1,437,568 | 12/1922 | Taplin . | |
| 1,639,462 | 8/1927 | McLaughlin . | |
| 1,866,696 | 7/1932 | Birman . | |
| 2,258,782 | 10/1941 | McKean . | |
| 2,381,509 | 8/1945 | Muenzen . | |
| 2,390,660 | 12/1945 | Muenzen . | |
| 2,749,911 | 6/1956 | Griffin . | |
| 2,769,182 | 11/1956 | Nunlist | 5/615 |
| 2,972,505 | 2/1961 | Weickgenannt . | |
| 3,506,988 | 4/1970 | Saddoris . | |
| 3,513,491 | 5/1970 | Gordon . | |
| 3,733,620 | 5/1973 | Glintz | 4/159 |
| 3,952,346 | 4/1976 | Carlson | 5/660 |
| 3,981,031 | 9/1976 | Schacht . | |
| 4,230,100 | 10/1980 | Moon | 606/242 |
| 4,768,241 | 9/1988 | Beney | 5/507.1 |
| 4,802,465 | 2/1989 | Slagle | 606/244 |
| 4,881,728 | 11/1989 | Hunter | 5/622 |
| 4,882,797 | 11/1989 | Failor et al. | 5/613 |
| 4,968,013 | 11/1990 | Kuck | 5/600 |
| 5,135,210 | 8/1992 | Michelson | 5/623 |
| 5,172,439 | 12/1992 | Farley | 5/464 |
| 5,231,741 | 8/1993 | Maguire | 5/612 |
| 5,335,384 | 8/1994 | Foster et al. | 5/622 |

FOREIGN PATENT DOCUMENTS

| | | | |
|---|---|---|---|
| 16268 | 5/1904 | Austria . | |
| 3300597 | 7/1984 | Germany | 5/660 |
| 2102282 | 2/1983 | United Kingdom . | |

OTHER PUBLICATIONS

Air Beds #96989 Nov. 16, 1869.
Pillows #370,772 Oct. 4, 1887.

*Primary Examiner*—Alexander Grosz
*Attorney, Agent, or Firm*—Barnes & Thornburg

[57] ABSTRACT

A hospital bed comprises a base, a patient support platform mounted above the base, and a selectively manipulable support integral with the platform. The support is movable to a position above the platform to raise the bed mattress and corresponding body part such as head, lumbar region of the back and/or the feet.

38 Claims, 4 Drawing Sheets

HOSPITAL BED WITH INTEGRAL SELECTIVELY MANIPULATABLE SUPPORT

FIELD OF THE INVENTION

This invention relates generally to patient supports, and more particularly to a hospital bed which includes integrally therewith a selectively manipulatable support.

BACKGROUND OF THE INVENTION

Hospital patients are typically supported atop patient supports, for example, hospital beds, during the patient's stay in a hospital. Traditionally, hospital beds have employed head, seat and leg platforms, or sections, most often serially hinged to one another to allow, for example, upward and downward pivoting of the head section, upward and downward pivoting of the leg section, and the like. Such adjustments are necessary to provide for patient comfort during the patient hospital stay.

In addition to movements of the hospital bed patient support platforms, in order to maintain patient comfort, additional supporting devices have also been employed in conjunction with the hospital bed, most notably pillows. For example, pillows are positioned under a patient's head and atop the hospital bed mattress, which is positioned atop the patient support platform, to provide for additional patient comfort. Other pillows may be positioned, for example, in the lumbar area of the patient's back, or under the knees, calves or feet, again atop the hospital bed mattress.

One problem associated with using pillows as such ancillary support items is that during shifting of the bed positions, i.e., upward and downward pivoting of the head section and upward and downward pivoting of the leg section, as well as during patient shifting atop the hospital bed, the pillows tend to become dislodged and must continually be replaced by care providers to their original position. Such is time consuming and creates an uncomfortable situation for the patient during the interim in which the pillows have become dislodged.

A number of modern hospital beds now employ specially designed treatment mattresses which support a patient and which bathe the patient with many small streams of cool air to provide a number of different types of therapeutic benefits. For example, low air loss mattresses are being employed which bathe the patient with many small streams of cool air to greatly reduce the tendency of patients to develop pressure sores. Such mattresses may also include pulsing effects which further help to constantly shift the areas of pressure applied to a patient's skin as the patient is supported by the mattress. In addition to low air loss mattresses or surfaces, numerous other specialty surfaces are being employed. For example, fluidized and dynamic surfaces, which include the use of liquid, air or gel media, or foam with air that passes through the foam, may be used.

Another problem in the use of traditional pillows with hospital beds which employ such specialty surfaces is that by placing a pillow atop the specialty surface between the surface and the patient's head, for example, the qualities and benefits of the specialty surface are in effect defeated. For example, in low air loss mattresses, when a pillow is placed between the low air loss surface and the patient's head, the low air loss feature in the scalp area is essentially totally eliminated. As the scalp area exhibits a rather high degree of skin breakdown due to pressure sores, it would be desirable to be able to retain the low air loss feature, yet at the same time to provide for ancillary supporting of the head, or other parts of the body, much like is done with traditional pillows.

It is therefore an objective of the present invention to provide a hospital bed or other patient supporting surface with an integral support which does not shift during movements of the hospital bed and movements of the patient atop the hospital bed.

It is another objective of the present invention to provide a support for a hospital bed or other type of patient support which can be used in conjunction with specialty surfaces and which does not negate or destroy the therapeutic effect of the specialty surfaces.

SUMMARY OF THE INVENTION

The present invention attains the stated objectives by providing a hospital bed comprising a base, a patient support platform mounted above the base and having a patient supporting surface thereon, and a selectively manipulatable support integral with said platform and movable to and between a position above the patient supporting surface and a position at or below the surface. When the selectively manipulatable support is in a position above the patient supporting surface, the support supports the patient. When the support is positioned at or below the surface, the patient is supported by the patient supporting surface.

Preferably, the selectively manipulatable support is mounted to the platform and is movable from a position below the patient supporting surface through the platform to a position above the patient supporting surface.

The hospital bed of the present invention can incorporate such a selectively manipulatable support in the head area, the lumbar area and/or the leg area.

In a preferred form, the selectively manipulatable support is rotatably mounted to the platform about an axis generally parallel a plane defined by the platform, and includes first and second opposed surfaces, with the first surface being located at a distance from the axis greater than a distance at which the second surface is located from the axis. When the first surface is positioned toward a patient on the bed, the patient is supported above the patient supporting surface and on the first surface of the support. When the second surface is positioned toward the patient the second surface is at or beneath the patient supporting surface, at which time the patient is supported on the patient supporting surface.

Preferably, the platform has an aperture therein which allows the first surface of the manipulatable support to pass therethrough to support a patient thereby.

According to another aspect of the present invention, a mattress is positioned atop the patient supporting surface. When the selectively manipulatable support is in the position above the patient supporting surface it supports the mattress and when the support is positioned at or below the surface the mattress is supported by the surface.

According to yet another aspect of the present invention, a section of a patient support is provided. The patient support comprises a platform having a patient supporting surface thereon, and a selectively manipulatable support integral with the platform and movable to and between a first position away from the patient supporting surface and toward a patient on the surface, and a second position away from the patient on the surface. When the selectively manipulatable support is in the first position, the selectively manipulatable support supports the patient away from the surface. When the selectively manipulatable support is in the second position the patient is supported by the surface.

In still another aspect of the present invention, the section of the patient support is provided with resilient cushioning material positioned against the patient supporting surface. When the selectively manipulatable support is in the first position the selectively manipulatable support supports the cushioning material and when the selectively manipulatable support is in the second position the cushioning material is supported by the surface.

In still a further aspect of the present invention, a hospital bed is provided which comprises a base, a patient support mounted above the base and having a patient supporting surface thereon, and a selectively manipulatable support rotatably mounted to the platform in the head area thereof and having a surface which projects above the patient supporting surface when in an operable position and which does not project above the patient supporting surface when in an inoperative position. A bed head extender is connected to the selectively manipulatable support which rotates to extend the length of the bed in the head area when the support is rotated to the operable position and which does not extend the length of the bed when the support is rotated to the inoperable position.

When utilized without the selectively manipulatable support, a rotating bed head extender is provided. In that form of the invention, a hospital bed comprises a base and a patient support platform mounted above the base. The platform includes a section in the head area thereof mounted for rotation about an axis generally parallel a plane defined by the platform and including a bed head extender connected thereto rotatable to extend the length of the bed in the head area when rotated to an operable position and which does not extend the length of the bed when rotated to an inoperable position.

One advantage of the present invention is that the invention provides a hospital bed or other patient support which includes a support which is integral with the bed such that the support does not shift when bed positions are shifted or when patient positions are shifted within the bed.

Another advantage of the present invention is that a hospital bed or other patient support is provided with such an integral support which can be selectively manipulated to either a supporting position or a non-supporting position.

Yet another advantage of the present invention is that in a hospital bed or other patient support employing a specialty treatment or therapeutic surface, the support does not interfere with or negate the therapeutic or treating features and advantages of the specialty mattress.

Still another advantage of the present invention is that a hospital bed or other patient support is provided with the above-mentioned integral selectively manipulatable support which further includes a head extender forming a part of the support.

These and other objects and advantages of the present invention will become more readily apparent during the following detailed description taken in conjunction with the drawings herein, in which:

DETAILED DESCRIPTION OF THE INVENTION

Figure 1:
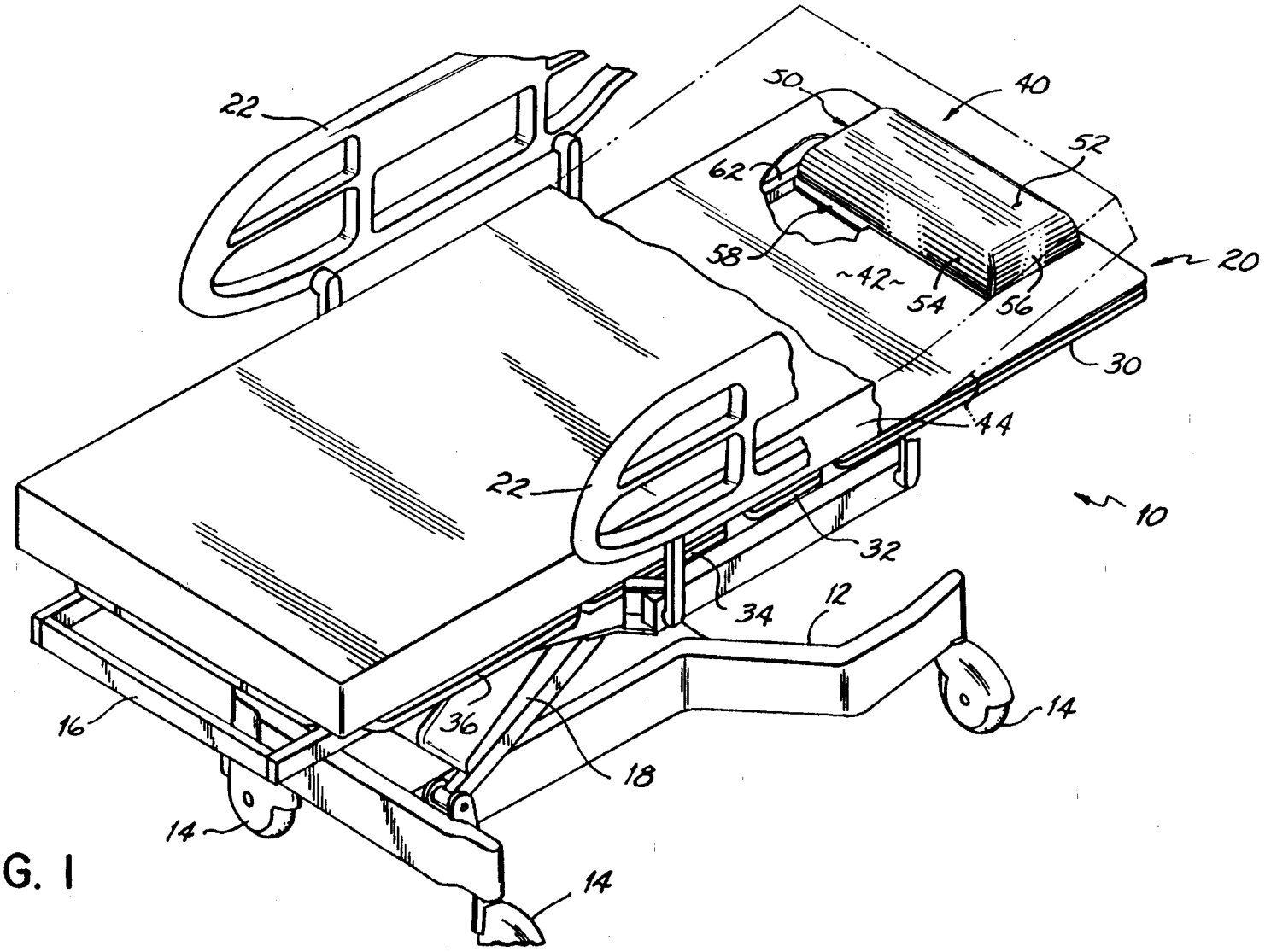
FIG. 1 is a perspective view of a hospital bed employing the present invention.

Referring first to FIG. 1, there is illustrated a hospital bed 10 including the principles of the present invention. The bed 10 includes, generally, a base 12, casters 14 mounted around the base 12, a main frame 16 vertically movably mounted above the base 12 via linkage 18, a patient support platform 20 mounted atop the main frame 16, and patient sideguards 22 mounted at either lateral side of the patient support platform 20.

Figure 2:
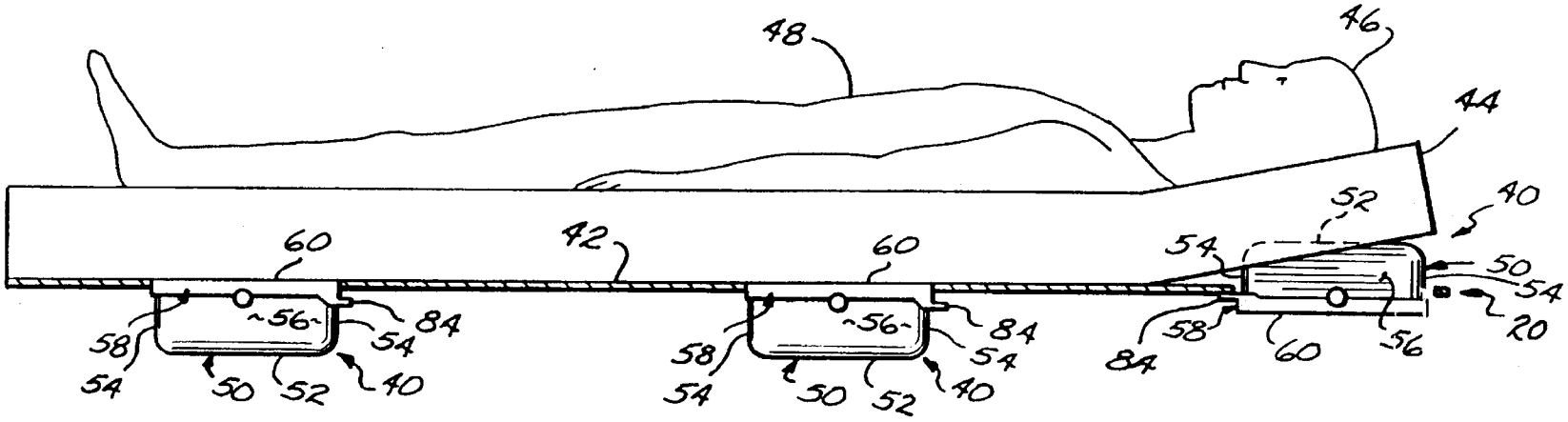
FIG. 2 is a side elevational view of a portion of the bed of FIG. 1 illustrating a number of supports according to the present invention employed on the bed.
Figure 3:
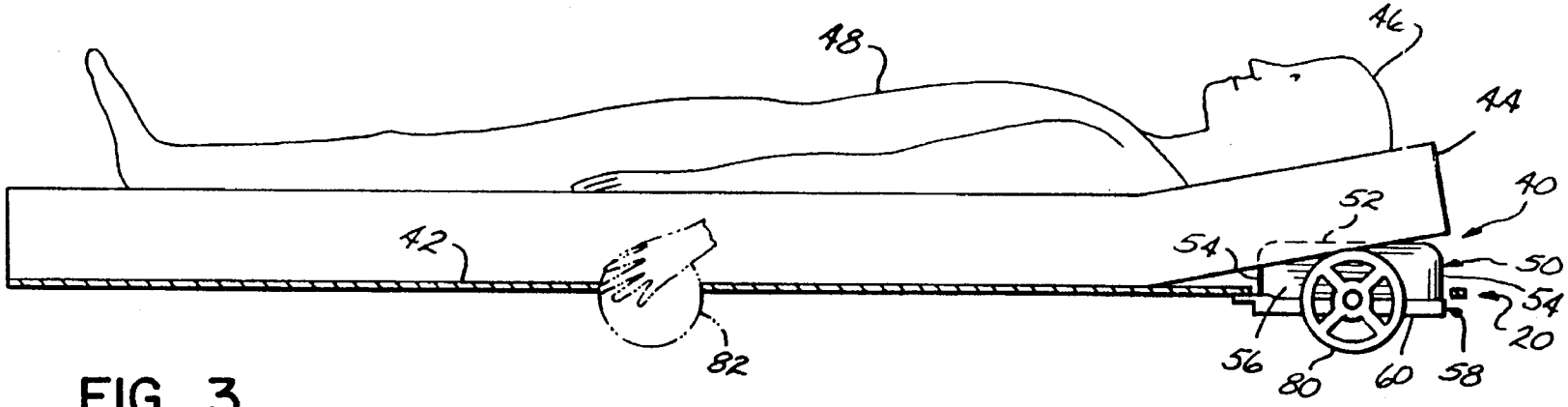
FIG. 3 is a view similar to FIG. 2 illustrating a means for manipulating the supports.

More particularly, patient support platform 20 comprises an upwardly pivoting head panel 30, a generally planar seat panel 32, a pivoting thigh panel 34 and a pivoting calf panel 36. In FIG. 1 the integral selectively manipulatable support is indicated generally at 40 and is shown in its operable position projecting above a patient supporting surface 42 of the head section 30 thereby raising the mattress 44 upwardly from the surface 42 and hence head 46 of a patient 48 (FIGS. 2 and 3).

Figure 4:
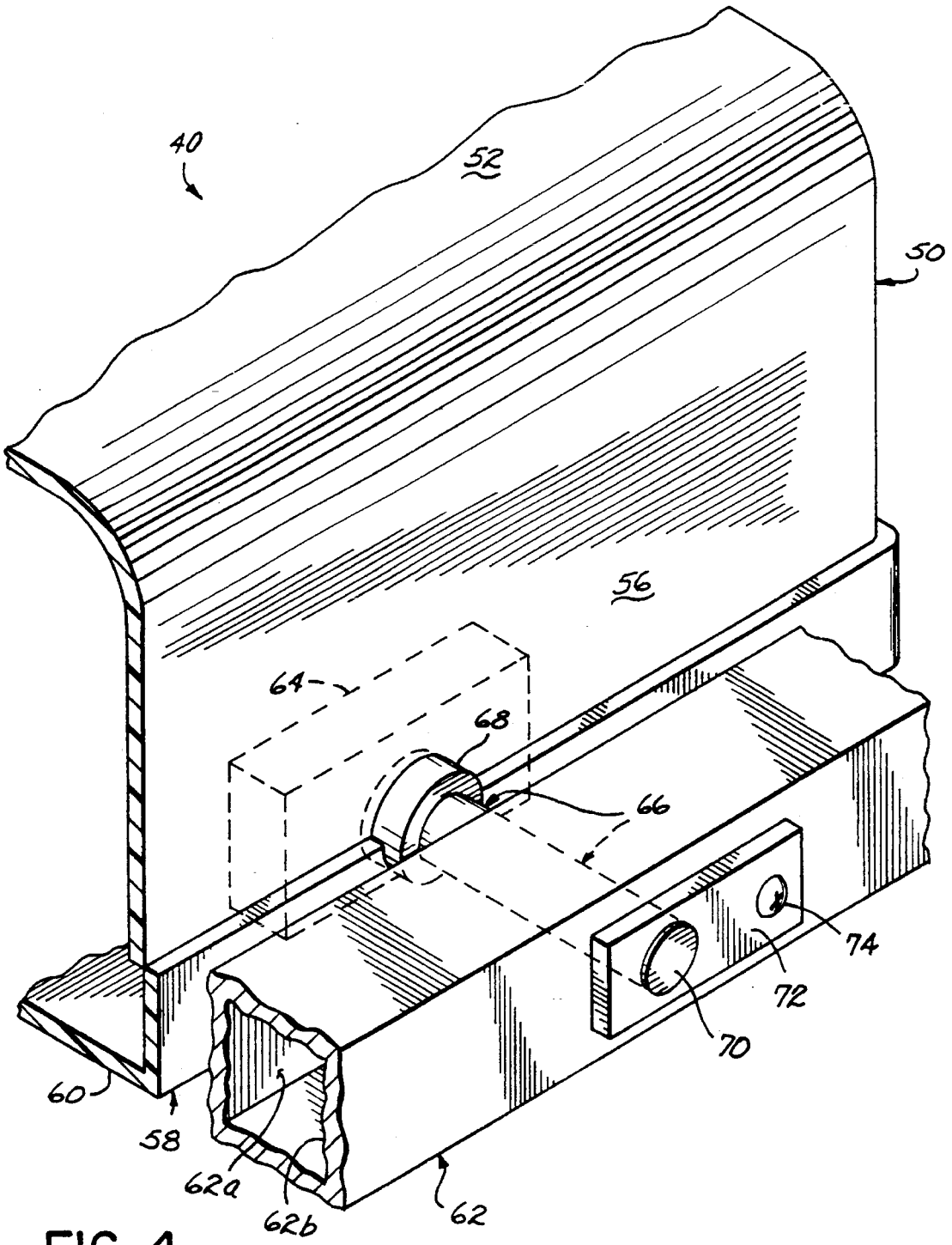
FIG. 4 is a partial perspective view, greatly enlarged, of the interconnection of one side of the support of the present invention to a hospital bed.

As shown in FIG. 4, the support 40 comprises a rectangularly shaped pillow portion 50 having a top wall defining an upper surface 52 and having two side walls 54 and two end walls 56. The structure 50 is approximately 9.75 inches wide by 19.25 inches long by 4.218 inches high. A lid 58 encloses the pillow structure 50 and defines a bottom wall having a bottom surface 60. The support 40 is preferably fabricated of polypropylene.

The support 40 is rotatably mounted to each siderail 62 of the main frame 16. A CELCON bushing 64 is secured to each of the end walls 56 of the structure 50 as by screws (not shown). A shaft 66 resides within hub 68 of the bushing 64 and passes through apertures (not shown) in the side walls 62*a* and 62*b* of rail 62. The outboard end 70 of shaft 66 is captured in a pivot BAR 72 which is itself secured to side wall 62*b* of rail 62 as by a screw 74. Thus, support 40 is able to rotate through approximately 180° to and between positions wherein the structure 50 is above the level of the surface 42 of the head section 30 and wherein the structure 40 is positioned below the surface 42 of the head section 30.

Figure 5A:
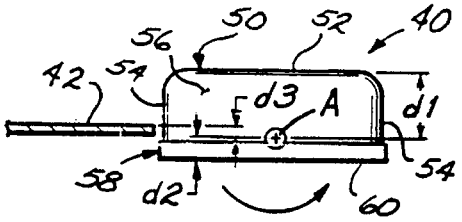
FIGS. 5A and 5B are side elevational views, in schematic form, of the present invention.
Figure 5B:
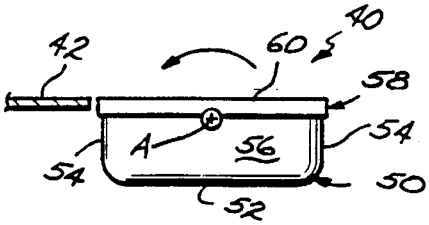

As can be seen in FIGS. 5A and 5B, 5A being the supporting position and 5B being the non-supporting position, the support 40 is rotated about an axis A. The surface 52 is located at a distance d1 from the axis A. Further, the surface 60 is located at a distance d2 from the axis A. The distance d1 is thus greater than the distance d2 in order to provide the supporting effect when the support 40 is rotated to the position in FIG. 5A. The surface 42 of head section 30 is located at a distance d3 from the axis A. Distance d2 is thus less than or equal to the distance d3, and preferably is equal to the distance d3 such that surface 60 is flush with surface 42 when the pillow support 40 is in the unsupporting position of FIG. 5B.

As shown in FIG. 2, the invention contemplates that the pillow structure 40 of the present invention could be employed at any number of locations on a hospital bed and is therefore not to be limited to simply the head position. For example, pillow supports 40 could be employed in the lumbar region of the back and also at or beneath the legs of the patient 48. Further, as is diagrammatically shown in FIG. 3, the invention contemplates a convenient means for moving the supports 40 to and between the supporting position as shown in FIG. 5A and the unsupporting position as shown in FIG. 5B. Such could take the form of a rotatable hand wheel 80. Wheel 80 could be, in one form, attached directly to the end 70 of the shaft 66. Thus, only a care provider would have immediate access to the wheel 80 for adjustment of the support 40. However, should one wish to provide patient 48 with access to adjustment of the support 40, wheel 80 could be provided in the position shown in phantom at 82 such that the wheel could be conveniently manipulated by the patient 48. Suitable mechanical linkage between the wheel 82 and the shaft 66 would of course be provided in order to drive the support 40.

As shown at 84, the tray portion 58 of the support 40 is provided with a lip to contact the underneath side of the rail 62 of the main frame 16 in order to serve as a stop. Further, the invention contemplates the use of a suitable means for dampening the rotation of the support 40 to maintain the desired rotational position of the support 40, i.e., at positions between that shown in FIG. 5A and FIG. 5B.

Figure 6A:
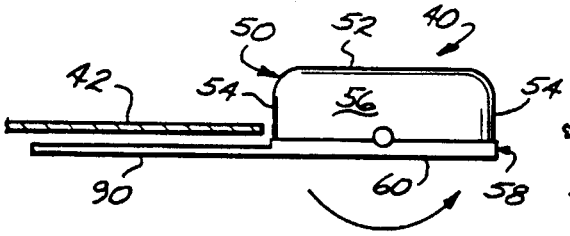
FIGS. 6A and 6B are side elevational views, in schematic form, of another form of the present invention.
Figure 6B:
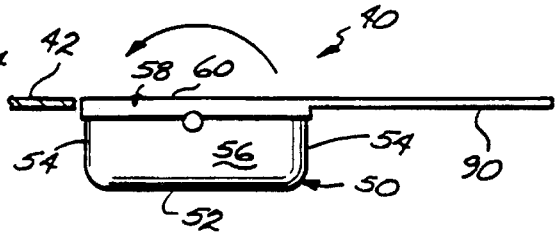
Figure 7A:
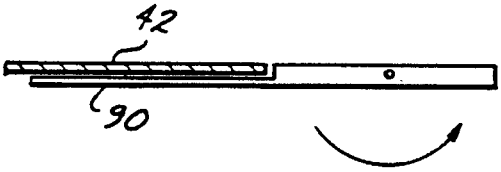
FIGS. 7A and 7B are side elevational views, in schematic form, of yet another form of the present invention.
Figure 7B:
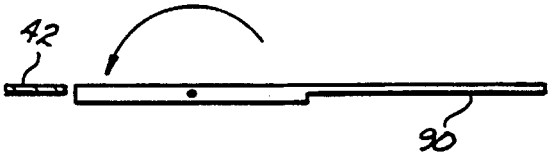
Figure 8:
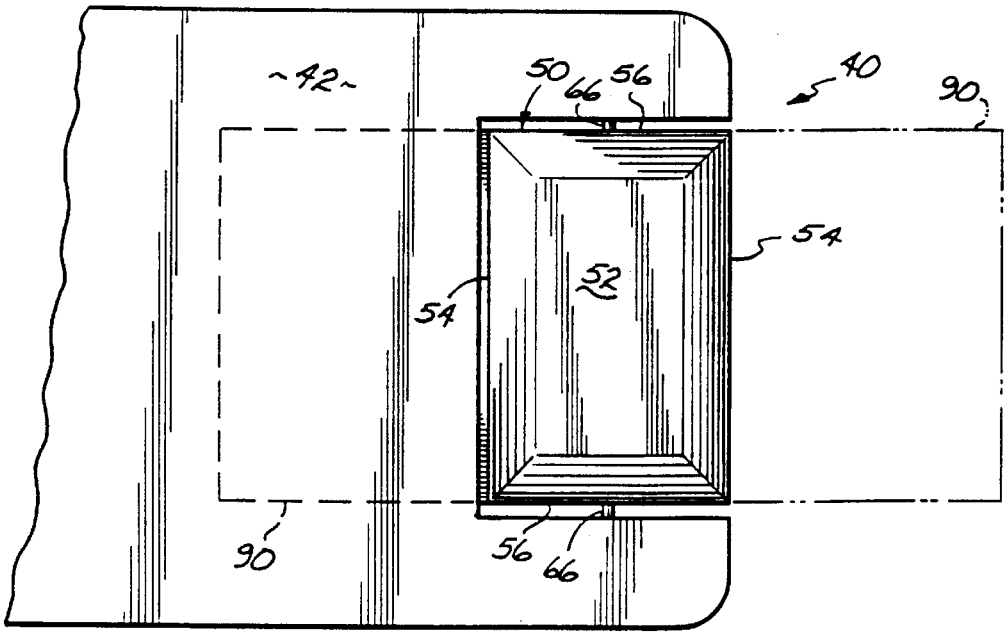
FIG. 8 is a top plan view of the alternative form of the present invention of FIGS. 6A and 6B.

As shown in FIGS. 6A and 6B, an alternative form of the present invention is illustrated. In this embodiment, the support 40 includes a head extender 90 forming a part of the tray 58. When the support 40 is rotated to the supporting position, as shown in FIG. 6A, the head extender is in the inoperable or non-extended position. When the support 40 is rotated to the non-supporting position, the head extender rotates through approximately 180° to extend the length of the bed 10 at the head area thereof. Such bed head extenders have a number of advantages, many of which are discussed in U.S. Pat. No. 5,335,384 issued Aug. 9, 1994, entitled A Hospital Bed Head Extender And Accessory Therefor and assigned to the assignee of the present invention, the entire substance of which is hereby incorporated by reference herein as if fully set forth in its entirety. This form of the invention is shown in top plan in FIG. 8. A further form of the invention is illustrated in FIGS. 7A and 7B, wherein the pillow structure 50 of the support 40 is eliminated thus resulting in a rotatable head extender.

In use, the support 40 is rotated to the supporting position when additional support is desired. For example, when located in the area of the head of the bed, the support acts as a traditional pillow, but does not have the drawbacks thereof such as negating the therapeutic effect of specialty mattress and the tendency to become dislodged. When support is not desired, the support is rotated to the nonsupporting position.

Those skilled in the art will readily recognize numerous adaptations and modifications which can be made to the present invention and which will result in an improved hospital bed with integral selectively manipulatable support, yet all of which will fall within the spirit and scope of the present intention as defined by the following claims. Accordingly, the invention is to be limited only by the scope of the following claims and their equivalents.

What is claimed is:

1. A hospital bed comprising:

a base;

a patient support platform mounted above said base and having a patient supporting surface thereon; and a selectively manipulatable support mounted to said platform and movable from a position at or below said patient supporting surface through said platform to a position above said patient supporting surface;

whereby when said selectively manipulatable support is in said position above said patient supporting surface said support supports a patient atop said bed and when said support is positioned at or below said surface said patient is supported by said surface, said selectively manipulatable support is rotatably mounted to said platform about an axis generally parallel a plane defined by said platform; and wherein said selectively manipulatable support includes first and second opposed surfaces, said first surface being located at a distance from said axis greater than a distance at which said second surface is located from said axis; whereby when said first surface is positioned toward a patient on said bed the patient is supported above said patient supporting surface and on said first surface of said selectively manipulatable support, and when said second surface is positioned toward the patient said second surface is at or beneath said patient supporting surface, at which time the patient is supported on said patient supporting surface.

2. A hospital bed comprising:

a base;

a patient support platform mounted above said base and having a patient supporting surface thereon; and a selectively manipulatable support rotatably mounted to said platform on an axis transverse to said platform and generally parallel a plane defined by said platform, said support having first and second opposed surfaces, said first surface being located at a distance from said axis greater than a distance at which said second surface is located from said axis;

said platform having an aperture therein to allow said first surface of said manipulatable support to pass therethrough;

whereby when said selectively manipulatable support is rotated to position said first surface through said aperture said support supports a patient atop said bed and when said support is rotated such that said second surface is toward the patient said second surface is at or beneath said patient supporting surface at which time the patient is supported on said patient supporting surface.

3. The hospital bed of claim 2 wherein said bed has a head area, said selectively manipulatable support being located in said head area.

4. The hospital bed of claim 1 wherein said bed has a lumbar area, said selectively manipulatable support being located in said lumbar area.

5. The hospital bed of claim 1 wherein said bed has a leg area, said selectively manipulatable support being located in said leg area.

6. A section of a patient support comprising:

a platform having a patient supporting surface thereon; and a selectively manipulatable support integral with said platform and movable to and between a first position away from said patient supporting surface and toward a patient on said surface, and a second position away from the patient on said surface;

whereby when said selectively manipulatable support is in said first position said selectively manipulatable support supports the patient away from said surface and when said selectively manipulatable support is in said second position the patient is supported by said surface, wherein said selectively manipulatable support is movable through said platform and is rotatably mounted to said platform about an axis generally parallel a plane defined by said platform, and wherein said selectively manipulatable support includes first and second opposed surfaces, said first surface being located at a distance from said axis greater than a distance at which said second surface is located from said axis, whereby when said first surface is positioned toward a patient the patient is supported on said first surface of said selectively manipulatable support, and when said second surface is positioned toward the patient the patient is supported on the patient supporting surface.

7. A hospital bed comprising:

a base;

a patient support platform mounted above said base and having a patient supporting surface thereon; and a selectively manipulatable support rotatably mounted to said platform in a head area thereof and having a surface which projects above said patient supporting surface in an operable position and which does not project above said patient supporting surface in an inoperable position; and a bed head extender connected to said selectively manipulatable support which rotates to extend the length of said bed in said head area when said support is rotated to said operable position and which does not extend the length of said bed when said support is rotated to said inoperable position.

8. A bed comprising:

a base;

a platform coupled to the base, the platform having a supporting surface facing upwardly away from the base; and a support rotatably coupled to the platform about an axis of rotation, the support including a first surface spaced apart a first distance from the axis and a second surface spaced apart a second distance from the axis, the second distance being less than the first distance.

9. The bed of claim 8, wherein the support is rotatable about the axis between a first position in which the first surface faces upwardly away from the base, and a second position in which the second surface faces upwardly away from the base.

10. The bed of claim 8, wherein the support is configured to rotate about 180° about the axis between the first position and the second position.

11. The bed of claim 8, wherein the platform has a thickness which is less than the first distance.

12. The bed of claim 11, wherein the thickness of the platform is substantially equal to the second distance.

13. The bed of claim 8, wherein the support includes spaced apart first and second side walls which extend between the first and second surfaces, the first and second side walls being substantially transverse to a longitudinal axis of the platform, and the axis of rotation being situated between the first and second side walls of the support.

14. The bed of claim 8, further comprising a shaft rotatably coupled to the support, and means for coupling the shaft to the platform to define the axis of rotation.

15. The bed of claim 8, wherein the platform defines a plane and the axis is substantially parallel to the plane.

16. The bed of claim 8, wherein the support is coupled to a head area of the platform.

17. The bed of claim 8, wherein the support is coupled to a lumbar area of the platform.

18. The bed of claim 8, wherein the support is coupled to a leg area of the platform.

19. The bed of claim 8, wherein the platform is formed to include an aperture configured to receive the support, the first surface passing through the aperture as the support rotates between the first and second positions.

20. The bed of claim 8, further comprising an actuator coupled to the support to rotate the support between the first and second positions.

21. The bed of claim 20, wherein the actuator is coupled to the platform spaced apart from the support.

22. A bed comprising:

a base;

a platform coupled to the base, the platform having a supporting surface facing upwardly away from the base; and a support rotatably coupled to the platform about an axis of rotation, the support including first and second surfaces, and the support being rotatable about the axis between a first position in which the first surface faces upwardly away from the base and extends generally parallel to the supporting surface and a second position in which the second surface faces upwardly away from the base and extends generally parallel to the supporting surface.

23. The bed of claim 22, wherein the second surface is situated between the platform and the base in the first position.

24. The bed of claim 22, wherein the first surface is situated between the platform and the base in the second position.

25. The bed of claim 22, wherein the first surface of the support is spaced apart a first distance from the axis of rotation, and the second surface of the support is spaced apart a second distance from the axis of rotation, the second distance being less than the first distance.

26. The bed of claim 22, wherein the support is configured to rotate about 180° about the axis between the first position and the second position.

27. The bed of claim 22, wherein the platform has a thickness which is less than the first distance.

28. The bed of claim 27, wherein the thickness of the platform is substantially equal to the second distance.

29. The bed of claim 22, wherein the support includes spaced apart first and second side walls which extend between the first and second surfaces, the first and second side walls being substantially transverse to a longitudinal axis of the platform, and the axis of rotation being situated between the first and second side walls of the support.

30. The bed of claim 22, further comprising a shaft rotatably coupled to the support, and means for coupling the shaft to the platform to define the axis of rotation.

31. The bed of claim 22, wherein the platform defines a plane and the axis is substantially parallel to the plane.

32. The bed of claim 22, wherein the support is coupled to a head area of the platform.

33. The bed of claim 22, wherein the support is coupled to a lumbar area of the platform.

34. The bed of claim 22, wherein the support is coupled to a leg area of the platform.

35. The bed of claim 22, wherein the platform is formed to include an aperture configured to receive the support, the first surface passing through the aperture as the support rotates between the first and second positions.

36. The bed of claim 22, further comprising an actuator coupled to the support to rotate the support between the first and second positions.

37. The bed of claim 36, wherein the actuator is coupled to the platform spaced apart from the support.

38. A bed comprising:

a base;

a platform coupled to the base, the platform having a supporting surface facing upwardly away from the base; and a support including first and second surfaces each having opposed ends, said support being rotatably coupled to the platform about an axis of rotation situated between the opposed ends of the first and second surfaces, and said support being rotatable between a first position where the first surface is spaced apart a first distance from the platform and a second position where the second surface is spaced apart a second distance from the platform, the second distance being less than the first distance.

* * * * *